United States Patent [19]

Fransen

[11] 4,406,972

[45] Sep. 27, 1983

[54] GETTERING DEVICE FOR COLOR TELEVISION DISPLAY TUBE

[75] Inventor: Jan J. B. Fransen, Eindhoven, Netherlands

[73] Assignee: U.S. Philips Corporation, New York, N.Y.

[21] Appl. No.: 246,475

[22] Filed: Mar. 23, 1981

[30] Foreign Application Priority Data

Mar. 26, 1980 [NL] Netherlands ..... 8001759

[51] Int. Cl.[3] ..... H01J 7/18

[52] U.S. Cl. ..... 313/481; 252/181.4; 252/181.6; 445/55

[58] Field of Search ..... 316/3, 25; 417/48; 252/181.4, 181.6; 313/481, 174, 176; 445/55

[56] References Cited

U.S. PATENT DOCUMENTS

| | | | |
|---|---|---|---|
| 2,624,450 | 1/1953 | Britten et al. | 252/181.4 X |
| 2,772,771 | 12/1956 | Wheldon et al. | 417/48 |
| 3,983,440 | 9/1976 | Scott et al. | 316/25 X |
| 4,077,899 | 3/1978 | van Gils | 252/181.4 |
| 4,302,063 | 11/1981 | Rudy | 316/25 |
| 4,342,662 | 8/1982 | Kimura et al. | 316/25 X |

*Primary Examiner*—Kenneth J. Ramsey
*Attorney, Agent, or Firm*—Robert J. Kraus

[57] ABSTRACT

A method of manufacturing a color television display tube, the envelope of which comprises a conical portion (11) and a window portion (12) which are sealed together in a vacuum-tight manner by means of a sealing glass (18). Before these portions are sealed together, a gettering device (21) is positioned inside the envelope of the tube, for example by attachment to the internal magnetic screening cap (17) or to the high-voltage contact (26). The gettering device (21) comprises a source of evaporable gettering metal and a material releasing gas upon heating. The gas-releasing material (5) is protected from the influence of moist air at comparatively high temperatures by means of a layer of metal (6) provided on the grains of the material (5). As a result of this the gettering device (21) is suitable for being assembled in a television display tube before the window (12) and the cone (11) of the tube have been sealed together by means of a sealing glass (18).

11 Claims, 3 Drawing Figures

GETTERING DEVICE FOR COLOR TELEVISION DISPLAY TUBE

BACKGROUND OF THE INVENTION

The invention relates to a method of manufacturing a colour television display tube having an envelope comprising a conical portion and a window portion sealed together in a vacuum-tight manner by means of a sealing glass. Prior to sealing said portions together, a gettering device is provided in a place situated inside the envelope of the tube. The gettering device comprises a source of evaporable gettering metal and a pulverulent material gas source for releasing gas upon heating. After evacuation of the display tube the gas is released from the gas source and the gettering metal is evaporated.

The invention furthermore relates to a colour television display tube thus manufactured, as well as to a gettering device suitable for use in the above-mentioned method.

A method of the kind described above is disclosed in British Patent Specification No. 1,226,728.

The source from which the gettering metal is evaporated usually consists of a mixture of nickel powder or a nickel alloy powder and a powdered alloy of gettering metal and aluminium. Suitable gettering metals are barium, strontium, calcium and magnesium. A frequently used source of gettering metal consists of a mixture of nickel powder and barium aluminium ($BaAl_4$) powder, which mixture contains approximately 40–60% by weight of nickel powder.

The source from which the gas is released as a scattering medium for the evaporating gettering metal usually consists of a nitrogen compound or a hydrogen compound from which the nitrogen or hydrogen is released by thermal decomposition. The quantity of released gas is adsorbed by the evaporated gettering metal. Examples of these compounds are iron nitride, nickel nitride, barium nitride, germanium nitride, titanium hydride and barium hydride. A very suitable gas source consists of pulverulent iron nitride ($Fe_4N$).

The usefulness of a gettering device is determined to a considerable extent by the extent to which it can withstand the influence of the surrounding atmosphere. The chemical composition of the components of the gettering device should not change under the conditions prevailing during the storage of the gettering device or during the manufacture of the tubes in which they are used. In this respect problems occur in particular when—as described in British Patent Specification No. 1,226,728—the gettering device is mounted in the tube before the display window of the tube has been sealed to the cone of the tube by means of a sealing glass. These envelope parts are sealed together in a furnace at a temperature of approximately 450° C. The sealing of the envelope parts lasts approximately one hour, and the components of the gettering device as such cannot withstand the influence of the surrounding atmosphere at the temperature occurring during this sealing process. British Patent Specification No. 1,226,728 proposes the use of a protective foil or layer of, for example, aluminium over the surface of the gettering device exposed to the atmosphere. However, this measure has proved to be not quite satisfactory in the conditions prevailing during the sealing together of window and cone of the tube.

Regarding the source of gettering metal, it has been suggested to replace the nickel powder in the source of gettering metal by a nickel-titanium compound or an iron-titanium compound which is more chemically resistant to the atmosphere existing during the sealing process. For a source of gettering metal consisting of a mixture of barium-aluminium powder ($BaAl_4$) and nickel powder, U.S. Pat. No. 4,077,899, the contents of which are incorporated herein by reference, discloses a way to improve the chemical resistance of the the mixture. This improvement is brought about by ensuring that the nickel powder has an average grain size smaller than 80 microns and a specific surface area smaller than 0.15 $m^2$ per gram, while the average grain size of the barium-aluminium powder is smaller than 125 microns.

It has proved necessary when using a gettering device which comprises a gas-releasing material, to take measures which prevent attack of the gas-releasing material by the ambient atmosphere at a premature stage of the manufacture of the tube in such a manner that it is unfit for use when the gettering device is fired.

SUMMARY OF THE INVENTION

It is an object of the invention to provide a method of manufacturing a colour television display tube in which a gettering device is used which, prior to sealing the conical portion to the window portion of the tube, can be provided in a place situated inside said conical portion or window portion, the gettering device having a gas source of gas-releasing material, which can be exposed to moist air at 450° C. for at least one hour without any deleterious effect on the gas-releasing material.

In accordance with the invention, a method of the kind mentioned in the opening paragraph is characterized in that the particles of the pulverulent gas-releasing material are covered by a metal layer. The metal layer on the particles of gas-releasing material protects the material from attack by the ambient atmosphere. In contrast with a gettering device in which the particles of gas-releasing material are not covered by a metal layer, a gettering device according to the invention remains fully useful even after having been exposed to moist air at 450° C. for one hour. Metal layers having a thickness of a few hundredths of a micron to approximately one micron give sufficient protection to realize the object of the invention. According to an embodiment of the invention, the layer thickness is approximately 0.05–1 micron. When a suitable gas-releasing material is used, for example, iron nitride ($Fe_4N$), and the nitride is exposed to moist air at 450° C., the layer prevents the nitrogen of the nitride from being replaced by oxygen.

A suitable method of providing metal layers on the particles of the pulverulent material is that method which is known as electroless plating. Particularly suitable metals for use in gettering devices according to the invention are nickel, cobalt and alloys thereof.

A major advantage of a gettering device according to the invention as compared with known gettering devices is that during the manufacture of a display tube it can be mounted in its place inside the tube envelope before the window and the cone of the display tube are sealed together. This is important particularly in the manufacture of display tubes having a resistive layer provided internally on a part of the tube wall. Such a display tube is disclosed in the above-mentioned British Patent Specification No. 1,226,728. This resistive layer is present near the neck-cone transition of the tube, which necessitates the mounting of the gettering device in a place in the tube which is remote from the neck-cone transition so as to avoid the resistive layer being short-circuited by gettering metal evaporated from the gettering device. In that case, due to the usually difficult accessibility of such a place, there exists a great need for the possibility of providing the gettering device in this place remote from the neck-cone transition before the cone is secured to the window of the tube.

The gettering device may also be used in the manufacture of black-and-white display tubes. The resistance of the gettering device to the action of the ambient atmosphere as such is a great advantage since this enables storage of the gettering device for a long period of time without reducing the usefulnes of the gettering device.

BRIEF DESCRIPTION OF THE DRAWING

Embodiments of the invention will now be described in greater detail by way of example, with reference to the drawing, in which.

DESCRIPTION OF THE PREFERRED EMBODIMENT

Figure 1:
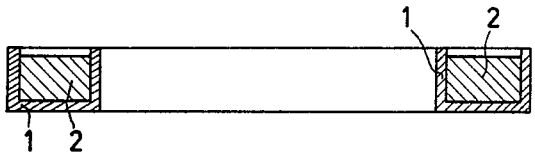
FIG. 1 is a sectional view of a gettering device according to the invention having an annular holder.
Figure 2:
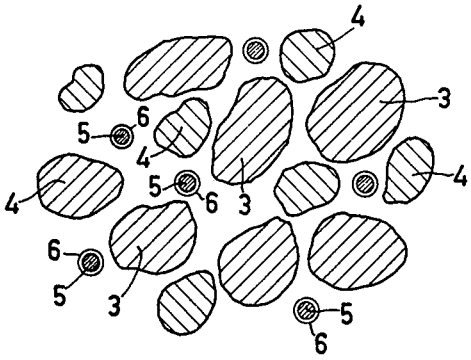
FIG. 2 shows enlarged the pulverulent filling material of the gettering device shown in FIG. 1.

The gettering device shown in FIG. 1 consists of a chromium nickel steel channel 1 in which a pulverulent filling material 2 is compressed. The filling material 2 comprises a source of gettering metal consisting of a mixture of barium-aluminium ($BaAl_4$) powder and nickel powder, containing from 40 to 60% by weight of nickel powder, as well as a gas source of gas-releasing material consisting from approximately 1.5–4% by weight (expressed in terms of the total quantity of filling material of iron nitride powder ($Fe_4N$), the particles of which are coated with a layer of nickel. FIG. 2 shows the filling material on an enlarged scale with barium-aluminium particles 3 having an average grain size of which is approximately 80 microns, nickel particles 4 having an average grain size between 30 and 60 microns, and iron nitride particles 5 having an average grain size between 5 and 10 microns. The filling material 2 is composed of approximately 20 parts by weight of barium-aluminium, 20 parts by weight of nickel and 1 part by weight of iron nitride. The specific surface area of the nickel powder is less than 0.15 $m^2$ per gram. This source of the gettering metal can be exposed to moist air at 450° C. for one hour without any deterioration. In order to prevent attack of the iron nitride in these circumstances, the iron nitride particles 5 are coated with a nickel layer 6 which is approximately 0.1 micron thick. A very suitable method of coating the iron nitride particles is the method known as electroless plating. As an example of such a method, the iron nitride particles are immersed in a bath containing a reducing agent and a water-soluble nickel salt, the pH of the bath being approximately 9 to 10 and the bath temperature being between 50° and 90° C. A suitable bath composition comprises, for example, 25 g/liter of nickel chloride ($NiCl_2.6H_2O$) and 8 ml/liter of hydrazine hydrate ($N_2H_4.H_2O$), in which the desired pH is obtained with a 10% aqueous solution of ammonia. After having thus been provided with a nickel layer, the iron nitride particles are decanted and dried.

Other metals can also be provided on pulverulent material by means of electroless plating. Furthermore, other materials suitable as a gas source may also be selected instead of iron nitride. This freedom also applies with respect to the choice of the gettering metal, so that strontium, calcium or magnesium may be used instead of barium. The invention is therefore not restricted to the above-described embodiment. Essential for the invention is the provision of a gettering device comprising a source of evaporatable gettering metal and a gas source from a gas-releasing material in powder form, in which the particles of gas-releasing material are coated with a metal layer so as to protect them from attack by an ambient atmosphere which attacks the gas-releasing material.

Figure 3:
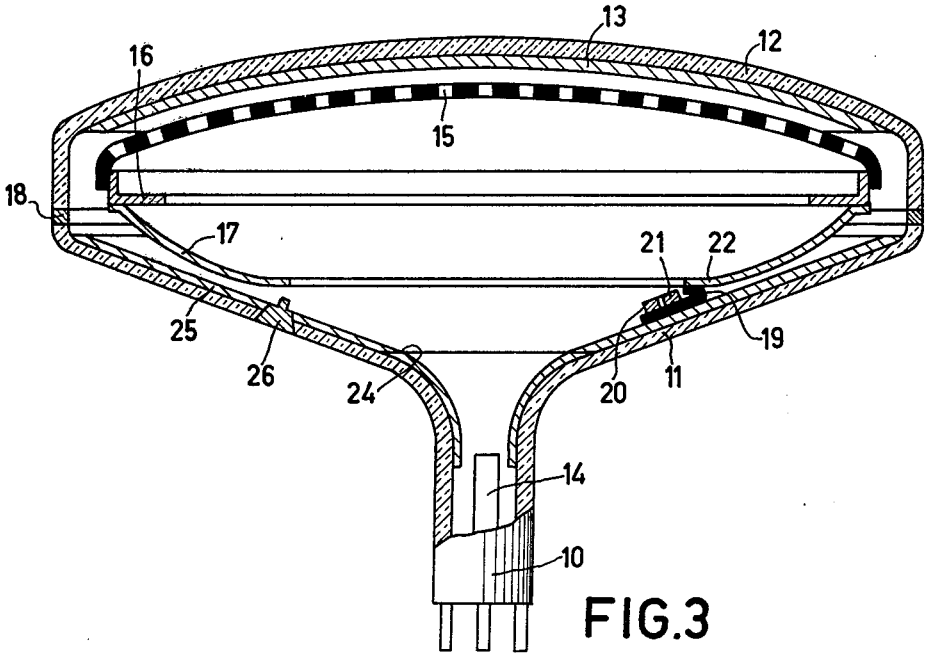
FIG. 3 is an axial sectional view of a colour television display tube manufactured while using the gettering device shown in FIG. 1.

Since a gettering device according to the invention provides great freedom with respect to the stage in the manufacturing process of a display tube at which the gettering device is mounted within the envelope of the display tube, the invention is very suitable for use in the manufacture of display tubes in which the gettering device is mounted within the envelope at an early stage of the manufacturing process. This aspect of the invention will be explained with reference to FIG. 3. The colour television display tube shown diagrammatically therein has a neck 10, a cone 11 and a window 12 of glass. On the inside of the window 12 a layer 13 of regions luminescing in red, green and blue is provided which in known manner form a pattern of lines or a pattern of dots. The tube furthermore comprises a metal shadow mask 15 and a metal magnetic screening cap 17, which are secured to a metal supporting frame 16. A source of gettering metal in the form of a mixture of barium-aluminium powder and nickel powder, as well as a source of nitrogen in the form of iron nitride powder are present in a metal annular holder 20 of a gettering device 21, as described with reference to FIGS. 1 and 2. A metal strip 19 is welded to the holder and is secured to the screening cap 17 at 22. It is also possible to secure the strip 19 to a high-voltage contact 26 sealed in the tube wall. After having mounted the gettering device 21 in its place, the window 12 is connected to the cone 11 in a vacuum-tight manner by means of a sealing glass 18. During this process, which lasts approximately one hour and is carried out in a furnace at a temperature of approximately 450° C., water vapour is released from the sealing material 18. The gettering device 21 according to the invention can be exposed to these conditions without any deterioration. After the sealing process, a system of guns 14 shown diagrammatically and with which three electron beams can be generated, is placed in the neck of the tube and the tube is evacuated.

Finally, the gettering device is inductively heated to a temperature range in which first nitrogen is introduced into the tube by thermal decomposition of the iron nitride and then an exothermic reaction is established between the barium-aluminium and the nickel, the barium evaporating and, scattered by the nitrogen, being desposited as a thin layer of gettering metal on surfaces situated inside the space between the mask 15 and the screening cap 17. The gettering device is positioned and oriented such that, with respect to a resistive layer 25 provided on the inner surface of the tube, the part situated between the line denoted by 24 and the gun system 14 is not covered with barium. In fact, the object of such a resistive layer is to minimize the detrimental results which a possible high-voltage breakdown in the tube may have for certain components in the control circuit connected thereto. In a conventional arrangement where the gettering device is connected to the gun system, or to an element connected to the gun system, the resistive layer is short-circuited by the deposited barium. This is prevented by using the above-described disposition of the gettering device.

Although the invention has been described with reference to a gettering device comprising a mixture of barium aluminium powder and nickel powder as a source of gettering metal and comprising iron nitride as a source of gas, it is not restricted thereto. The invention may also be practiced by using other gettering metals, for example, strontium, calcium or magnesium. In order to obtain a chemically resistant source of gettering metal, measures other than those described above may be taken. For example, the nickel powder in said source may be replaced by a chemically more resistant nickel-titanium compound or iron titanium compound.

Furthermore, the invention has been explained with reference to a gettering device in which the material of the gas source is mixed with the material of the gettering metal source, but the invention can also be used successfully in gettering devices such as those described in U.S. Pat. No. 3,669,567 where the gas-releasing material of the gas source is accommodated in a separate holder.

What is claimed is:

1. A color television display tube including a gettering device positioned therein, said gettering device comprising a source of evaporable gettering metal and at least one gas source of pulverulent gas-releasing material, characterized in that the particles of the pulverulent gas-releasing material are covered by a metal layer.

2. A gettering device comprising a source of evaporable gettering metal and at least one gas source of pulverulent gas-releasing material, characterized in that the particles of the pulverulent gas-releasing material are covered by a metal layer.

3. A gettering device as claimed in claim 2, characterized in that the metal layer on the particles has a thickness of a few hundredths of a micron to approximately one micron.

4. A gettering device as claimed in claim 3, characterized in that the metal layer has a thickness of approximately 0.05–1 micron.

5. A gettering device as claimed in any of claims 2, 3, or 4, characterized in that the metal layer on the particles consists of a metal selected from the group consisting of nickel, cobalt and alloys thereof.

6. A gettering device as claimed in claim 5 characterized in that the metal layer on the particles is an electoless plated layer.

7. A gettering device as claimed in claim 6 characterized in that the source of gettering metal comprises a mixture of barium-aluminum powder ($BaAl_4$) and nickel powder and the gas source of gas-releasing material comprises pulverulent iron nitride ($Fe_4N$), the nickel powder having an average grain size smaller than 80 microns and a specific surface area smaller than 0.15 $m^2$ per gram, while the average grain size of the barium-aluminium powder is smaller than 125 microns.

8. A gettering device as claimed in claim 5 characterized in that the source of gettering metal comprises a mixture of barium-aluminum powder ($BaAl_4$) and nickel powder and the gas source of gas-releasing material comprises pulverulent iron nitride ($Fe_4N$), the nickel powder having an average grain size smaller than 80 microns and a specific surface area smaller than 0.15 $m^2$ per gram, while the average grain size of the barium-aluminium powder is smaller than 125 microns.

9. A gettering device as claimed in claim 2, 3, or 4 characterized in that the metal layer on the particles is an electroless plated layer.

10. A gettering device as claimed in claim 9 characterized in that the source of gettering metal comprises a mixture of barium-aluminum powder ($BaAl_4$) and nickel powder and the gas source of gas-releasing material comprises pulverulent iron nitride ($Fe_4N$), the nickel powder having an average grain size smaller than 80 microns and a specific surface area smaller than 0.15 $m^2$ per gram, while the average grain size of the barium-aluminium powder is smaller than 125 microns.

11. A gettering device as claimed in claim 2, 3, or 4 characterized in that the source of gettering metal comprises a mixture of barium-aluminium powder ($BaAl_4$) and nickel powder and the gas source of gas-releasing material comprises pulverulent iron nitride ($Fe_4N$), the nickel powder having an average grain size smaller than 80 microns and a specific surface area smaller than 0.15 $m^2$ per gram, while the average grain size of the barium-aluminium powder is smaller than 125 microns.

* * * * *